United States Patent [19]

Schosek

[11] Patent Number: 4,492,133

[45] Date of Patent: Jan. 8, 1985

[54] UNDERGROUND PIPE OR CABLE INSTALLATION

[75] Inventor: William O. Schosek, North Fort Myers, Fla.

[73] Assignee: Elephant Industries, Inc., North Ft. Myers, Fla.

[21] Appl. No.: 404,428

[22] Filed: Aug. 2, 1982

[51] Int. Cl.[3] ..... B25B 17/00

[52] U.S. Cl. ..... 81/57.3; 81/57.18; 81/57.2; 81/114

[58] Field of Search ..... 81/57.3, 114, 57.18, 81/57.20, 57; 29/240; 294/114, 116; 269/229; 279/37, 43, 107

[56] References Cited

U.S. PATENT DOCUMENTS

| | | | |
|---|---|---|---|
| 121,340 | 11/1871 | Deavs | 279/107 |
| 347,681 | 8/1886 | Bradley | 81/114 |
| 1,786,701 | 12/1930 | Butlin | 81/114 |
| 2,733,925 | 2/1956 | Denzler | 279/43 |
| 2,746,331 | 5/1956 | Andersen | 81/57.3 |
| 4,098,151 | 7/1978 | Bliss | 81/57.3 |

FOREIGN PATENT DOCUMENTS

| | | | |
|---|---|---|---|
| 962575 | 12/1949 | France | 81/57.3 |

*Primary Examiner*—James L. Jones, Jr.
*Attorney, Agent, or Firm*—Alfred E. Wilson

[57] ABSTRACT

In instances where it is necessary to install a pipe or cable under a road or sidewalk without forming an open topped trench through the road or sidewalk, it is desirable that the operating trench in which the installing device is positioned be as narrow as possible. This is desirable to avoid disrupting the ground adjacent the road or sidewalk more often than is necessary. The installing device is positioned in the bottom of the operating trench, and clampingly engages the actuating rod and forces it axially under the road or sidewalk. Short installation rod segments are threadedly connected into the installation rod in the narrow and deep trench as the installing device pushes the installation rod under the road or sidewalk. To threadedly connect the short rod segments into the installation rod an elongated rod segment threader successively engages the rod segments and is positioned in the ditch and aligns them with the actuating rod at the bottom of the operating trench. By actuation of a clutching drive mechanism the operator, located at the top of the narrow and deep trench, is able to connect the rod segments into or remove them from the installation rod.

1 Claim, 5 Drawing Figures

UNDERGROUND PIPE OR CABLE INSTALLATION

BACKGROUND OF THE PRESENT INVENTION

Heretofore it has been necessary to dig a relatively wide operating trench to accomodate a man to align and connect up a newly installed installation rod segment with the previously installed rod segments and tighten them into the installation rod. This relatively wide and large operating trench necessitated a considerable disruption of the ground which in many instances is undesirable because frequently there are plantings and other obstructions in the area which of necessity must be destroyed.

In my copending application W-2493, Ser. No. 394,621 filed July 2, 1982, now Pat. No. 4,455,107. I disclosed a very narrow installation rod installing device capable of installing a pipe or cable in a very narrow operating trench, of the order of six inches wide and three to four feet deep without the necessity of digging a hole to accomodate a man to connect up the rod segments. With the advent of that invention it became necessary to devise some mechanism capable of installing and connecting up the rod segments in such a narrow and deep operating trench without the necessity of digging a wide hole at the end to accomodate a man to make the connections.

OBJECTS OF THE PRESENT INVENTION

An object of this invention is to permit the installation of a sectionalized installation rod in a narrow and deep operating trench.

Another object resides in the provision of a cam actuated ratchet drive mechanism for clamping and connecting up a rod segment to an installation rod positioned in a deep narrow operating trench.

A further object is to provide an installation rod installing device having a cam operated member to engage and clamp a rod segment for installation in a deep and narrow operating trench, and a rod threader or motion transmitting device to tighten a rod segment into an operating rod positioned in the operating trench.

Another object of my invention is to provide a remotely operable combination cam operated rod clamping and ratchet controlled rotating mechanism whereby a rod segment can be clampingly engaged and tightened into and removed from an operating rod, positioned in a narrow and deep operating trench.

DETAILED DESCRIPTION OF A PREFERRED EMBODIMENT

Figure 1:
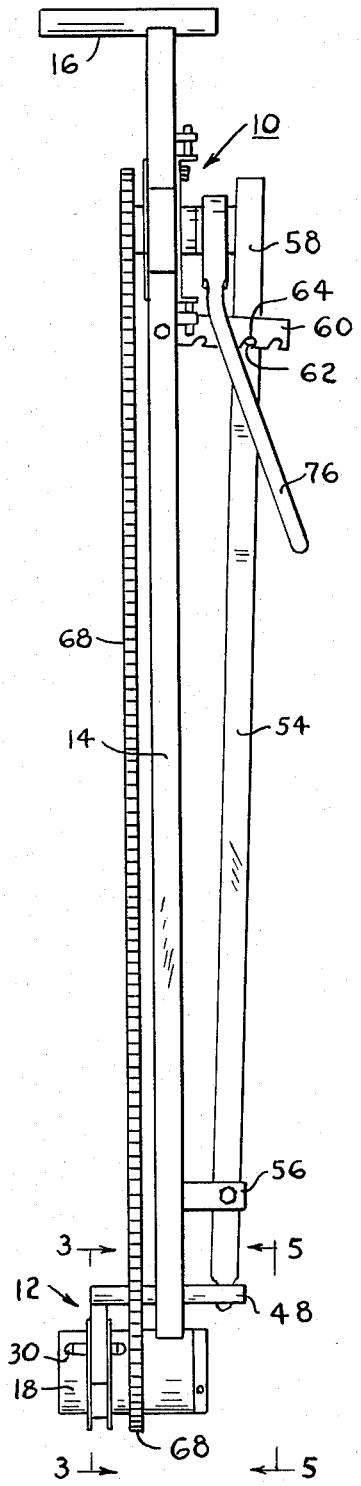
FIG. 1 is a side elevational view of a device for connecting together installation rod segments positioned in a deep and narrow operating trench.
Figure 2:
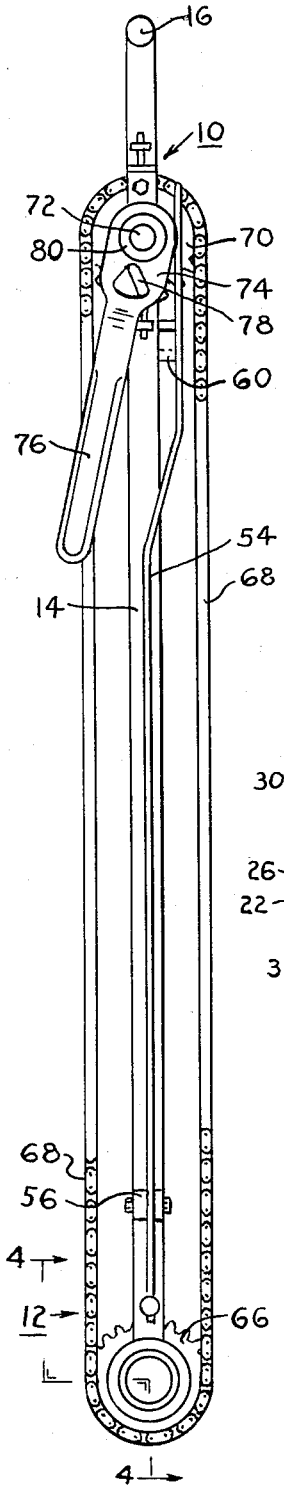
FIG. 2 is a front elevational view thereof.
Figure 3:
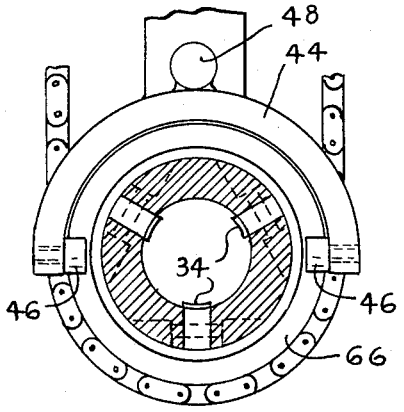
FIG. 3 is an enlarged sectional view taken substantially on the line 3—3 of FIG. 1 looking in the direction of the arrows.

Referring now more particularly to FIGS. 1 and 2 a remotely operable rod segment holding and rotating device is illustrated. This rod threader has an upper control end 10 and a lower rod clamping and rotating end 12. The upper and lower ends 10 and 12 are connected by a frame 14, preferable of tubular square consturction. The frame 14 has a handle 16 welded or otherwise secured to it by which the device may be readily grasped and manipulated.

Figure 4:
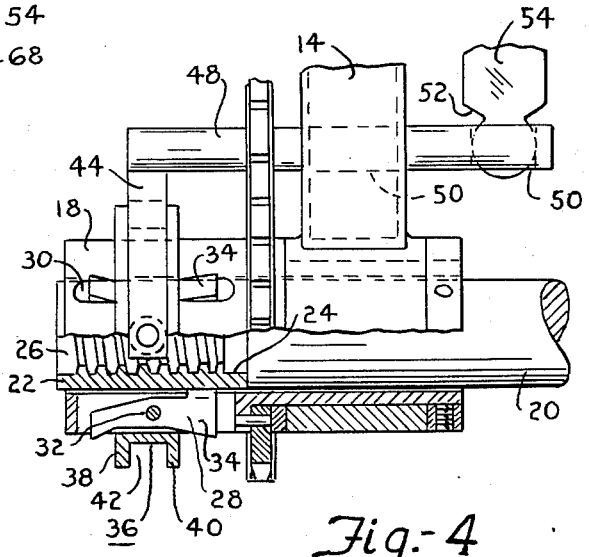
FIG. 4 is an enlarged broken sectional view taken on the staggered line 4—4 of FIG. 2 looking in the direction of the arrows.
Figure 5:
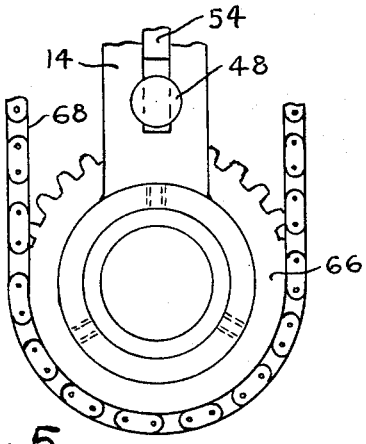
FIG. 5 is an elevational view taken substantially on the line 5—5 of FIG. 1, looking in the direction of the arrows.

The lower rod segment clamping and rotating end 12 has a cylindrical rod clamping holder 18 adapted to receive a rod segment 20 of an internally threaded coupler 22 adapted to receive the externally threaded ends of the rod segments 20 as illustrated in FIG. 4.

To provide a radially solid connection between the rod segments 20 and the couplers 22 the rods 20 at the base of the threads on the rods have an unthreaded shoulder portion 24 adapted to provide a snug fit into an unthreaded lead in shoulder 26 of the coupler 22 to provide a radially solid connection capable of withstanding the high radial loading of the installation rod as the rod is clamped by jaws to push it forwardly in the pipe installing process as disclosed in my earlier U.S. Pat. No. 4,309,122 previously referred to.

Circumferentially spaced cam actuated rod or coupler gripping jaws 28 are pivotally mounted in axially extending slots 30 formed in the holder 18. The jaws 28 are angularly movable on pins 32 in the holder 18 for rotation with the rod or coupler when the clutch members 34 thereof are forced radially into engagement with the rod or coupler members 20 and 22.

The rod or coupler gripping jaws 28 are actuated by an axially shiftable circumferentially extending actuator 36 having radially extending flanges 38 and 40 defining therebetween a groove 42. A semicylindrical forked clutch actuator 44 having inwardly extending projections 46 projecting into the groove 42 to actuate the shiftable actuator 36 to engage the clutch members 34 with the rod 20 or coupling 22.

The clutch actuator 44 is secured to a rod 48 projecting through an aperture 50 through the frame 14, and having a slot 52 to receive the rounded lower actuating end 52 of a clutch operating lever 54 pivotally mounted in spaced brackets 56 secured to the tubular frame 14, and having an upper end 58 extending upwardly to the upper control end 10 of the device for manipulation by an operator. A pivoted position control member 60 is secured to the tubular frame member 14 and has a series of serrations 62 adapted to selectively receive a pin 64 carried by the clutch actuating lever 54 to vary the tension exerted on the rod segment 20 or the coupler 22.

The rod segment 20 and its associated coupler 22 may be rotated to thread the rod segment 20 being added into the previously installed operating rod. A sprocket 66, such for example as a bicycle chain sprocket is fixed to the rod clamping holder 18 and is driven by a bicycle chain 68 operably connected to another sprocket 70 rotatably mounted on a shaft 72 journalled in the tubular frame 14 at the upper control end 10 of the device.

The drive sprocket 70 is mounted on a shaft 72 actuated by a rachet mechanism 74 of conventional design having a handle 76 whereby the drive sprocket 70 may be rotated to any desired degree, an overriding or one way drive mechanism being provided to permit the ratchet handle 76 to "free wheel" or move rearwardly without effecting a drive.

A ratchet reversing control 78 is provided in the bub 80 of the ratchet mechanism to reverse the direction of drive of the ratchet mechanism.

The operation of the device is as follows. When it is desired to install a pipe or cable underground without disturbing the surface of the ground to a greater extent than is necessary, an operating trench is installed at one side of where the pipe is to be installed, and a target trench is installed at the other side.

By utilizing for example the underground pipe installer as disclosed in my copending application (W-2493) Ser. No. 394,621 filed July 2, 1982, now Pat. No. 4,455,107 it is only necessary to prepare an operating trench of approximately six inches wide by three or four feet deep depending on how deep it is desired to install the pipe. A first length of the operating rod is installed in the underground pipe installer, and it is pushed forwardly into the ground in the area where the pipe is to be installed by operation of the machine.

A rod segment 20 is then installed in the rod clamping holder 18 while the cams 34 are in the position to release the rod 20 with the actuator 36 in the left hand position as viewed in FIG. 4. At that time the clutch actuating lever 54 will be in the right hand position as viewed in FIG. 1. The rod segment 20 is then installed in the rod clamping holder 18, and the clutch actuating lever 54 is then moved to the left as viewed in FIG. 1 to engage the clutch members 34 with the rod segment 20 to firmly grip and lock rod segment 20 in the rod threader.

The rod threader or trench wrench is then positioned in the operating trench with its lower rod clamping and rotating end 12 positioned in alignment with the driving jaws of the underground pipe installing device. The threads on the rod segment 20 or coupler 22 are then positioned in engagement with the threads of the previously installed rod or coupler. The ratchet reversing control 78 of the ratchet mechanism 74 is positioned to rotate the cylindrical holder 18 and the rod segment 20 in the direction to tighten the rod segment 20 into the previously installed rod. The ratchet handle 76 is then actuated in the usual way to rotate the drive sprocket 70 chain 68 and sprocket 66 to rotate the holder 18 and the rod segment 20 to tighten the rod segment 20 into the previously installed rod.

When the rod segment has thus been tightened, the actuating lever 54 is moved to the right as viewed in FIG. 1 to release the rod segment 20. The rod installing device is then removed from the rod segment 20 by shifting it off of the end of the rod.

The rod installing device then proceeds to drive the installation rod segment 20 to the extent of the length of the rod segment 20 whereupon another rod segment is assembled with the rod threader and the operation is repeated as herein stated.

When the end of the coupled up operating rod emerges in the target trench the pipe or cable to be installed is attached to the end of the rod, as for example by the device disclosed in my previously issued U.S. Pat. No. 4,318,639 issued Mar. 9, 1982.

The rod engaging jaws of the pipe installing device are reversed to pull the operating rod back toward the operating trench. The ratchet reversing control 78 for the ratchet mechanism 74 of FIG. 2 hereof is moved to reverse the operation of the ratchet. Actuation of the ratchet handle 76 will funtion to release one length of the rod segment 20 at a time, the rod being held in the jaws of the rod installing device, and being withdrawn into the operating trench one length of the rod at a time until the pipe or cable to be installed emerges in the operating trench.

I claim:

1. In an underground pipe installing device wherein short installation rod segments are successively threadedly connected into an installation rod positioned in a narrow and deep operating trench for penetration by an underground pipe installing device through the earth to a remotely spaced target trench, comprising an elongated rod threader adapted to be positioned in a substantially vertical position in the narrow and deep operating trench, and having a rod segment engaging clutch and a rod segment rotational drive mechanism of the rod threader at the lower end to align short installation rod segments with the installation rod, and a manually operated clutch actuating control and a manually operable rotational drive mechanism at the upper end of the rod threader, motion transmitting means between opposite ends of the rod threader, the opposite ends of the rod threader being connected by a tubular frame member, and the rod segment engaging clutch having a rod holder and radially pivoted cams to clampingly engage the rod segments, and manually operable means at the upper end of the rod threader to actuate the clutch.

* * * * *